US006631572B1

(12) United States Patent
Garcia

(10) Patent No.: US 6,631,572 B1
(45) Date of Patent: Oct. 14, 2003

(54) REFILLABLE DISPENSING APPARATUS

(76) Inventor: Maria E. Garcia, 9 James St., Montrose, NY (US) 10548

( * ) Notice: Subject to any disclaimer, the term of this patent is extended or adjusted under 35 U.S.C. 154(b) by 0 days.

(21) Appl. No.: 10/037,873

(22) Filed: Jan. 4, 2002

(51) Int. Cl.[7] ..... D06F 75/22; D06F 79/00
(52) U.S. Cl. ..... 38/77.1; 38/94
(58) Field of Search ..... 38/77.1, 77.2, 38/77.3, 77.4, 94, 75, 88; 219/245; D23/68; 239/525

(56) References Cited

U.S. PATENT DOCUMENTS

| | | | | | |
|---|---|---|---|---|---|
| 2,011,285 | A | | 8/1935 | Jackson et al. | |
| 2,080,175 | A | * | 5/1937 | Kuno | 38/77.3 |
| 3,101,562 | A | | 8/1963 | Crawford | |
| 3,160,969 | A | * | 12/1964 | Ensley | 38/77.3 |
| 3,224,122 | A | * | 12/1965 | Jepson et al. | 38/77.2 |
| 3,300,884 | A | | 1/1967 | Giarraffa et al. | |
| 3,670,433 | A | | 6/1972 | Hardwick et al. | |
| 3,685,182 | A | | 8/1972 | Davidson et al. | |
| D293,952 | S | | 1/1988 | Hsu | |
| 5,630,287 | A | * | 5/1997 | Shimosaka et al. | 38/77.3 |

* cited by examiner

*Primary Examiner*—Ismael Izaguirre

(57) ABSTRACT

A refillable dispensing apparatus for mounting on a handle of a clothes iron and dispensing a fluid onto a surface of a piece of fabric. The refillable dispensing apparatus includes a housing that has an interior for holding a fluid and an access opening for accessing the interior of the housing. A plug is removably positioned in the access opening for selectively plugging the access opening. A nozzle is mounted on and extends away from a first end wall of the housing for emitting the fluid positioned in the interior of the housing. An actuating member is mounted on the housing and fluidly coupled to the nozzle for selectively receiving a finger of a user. A securing member is mounted to the housing for removably securing the housing to the handle of the clothes iron.

20 Claims, 1 Drawing Sheet

REFILLABLE DISPENSING APPARATUS

BACKGROUND OF THE INVENTION

1. Field of the Invention

The present invention relates to fluid dispensing devices and more particularly pertains to a new refillable dispensing apparatus for mounting on a handle of a clothes iron and dispensing a fluid onto a surface of a piece of fabric.

2. Description of the Prior Art

The use of fluid dispensing devices is known in the prior art. More specifically, fluid dispensing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,300,884; U.S. Pat. No. 3,101,562; U.S. Pat. No. 3,685,182; U.S. Pat. No. 3,670,433; U.S. Pat. No. 2,011,285; and U.S. Pat. No. Des. 293,952.

While these devices fulfill their respective, particular objectives and requirements, the aforementioned patents do not disclose a new refillable dispensing apparatus. The inventive device includes a housing that has an interior for holding a fluid and an access opening for accessing the interior of the housing. A plug is removably positioned in the access opening for selectively plugging the access opening. A nozzle is mounted on and extends away from a first end wall of the housing for emitting the fluid positioned in the interior of the housing. An actuating member is mounted on the housing and is fluidly coupled to the nozzle for selectively receiving a finger of a user. A securing member is mounted to the housing for removably securing the housing to the handle of the clothes iron.

In these respects, the refillable dispensing apparatus according to the present invention substantially departs from the conventional concepts and designs of the prior art, and in so doing provides an apparatus primarily developed for the purpose of mounting on a handle of a clothes iron and dispensing a fluid onto a surface of a piece of fabric.

SUMMARY OF THE INVENTION

In view of the foregoing disadvantages inherent in the known types of fluid dispensing devices now present in the prior art, the present invention provides a new refillable dispensing apparatus construction wherein the same can be utilized for mounting on a handle of a clothes iron and dispensing a fluid onto a surface of a piece of fabric.

The general purpose of the present invention, which will be described subsequently in greater detail, is to provide a new refillable dispensing apparatus apparatus and method which has many of the advantages of the fluid dispensing. devices mentioned heretofore and many novel features that result in a new refillable dispensing apparatus which is not anticipated, rendered obvious, suggested, or even implied by any of the prior art fluid dispensing devices, either alone or in any combination thereof.

To attain this, the present invention generally comprises a housing that has an interior for holding a fluid and an access opening for accessing the interior of the housing. A plug is removably positioned in the access opening for selectively plugging the access opening. A nozzle is mounted on and extends away from a first end wall of the housing for emitting the fluid positioned in the interior of the housing.

An actuating member is mounted on the housing and is fluidly coupled to the nozzle for selectively receiving a finger of a user. A securing member is mounted to the housing for removably securing the housing to the handle of the clothes iron.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that, the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new refillable dispensing apparatus apparatus and method which has many of the advantages of the fluid dispensing devices mentioned heretofore and many novel features that result in a new refillable dispensing apparatus which is not anticipated, rendered obvious, suggested, or even implied by any of the prior art fluid dispensing devices, either alone or in any combination thereof.

It is another object of the present invention to provide a new refillable dispensing apparatus which may be easily and efficiently manufactured and marketed.

It is a further object of the present invention to provide a new refillable dispensing apparatus which is of a durable and reliable construction.

An even further object of the present invention is to provide a new refillable dispensing apparatus which is susceptible of a low cost of manufacture with regard to both materials and labor, and which accordingly is then susceptible of low prices of sale to the consuming public, thereby making such refillable dispensing apparatus economically available to the buying public.

Still yet another object of the present invention is to provide a new refillable dispensing apparatus which provides in the apparatuses and methods of the prior art some of the advantages thereof, while simultaneously overcoming some of the disadvantages normally associated therewith.

Still another object of the present invention is to provide a new refillable dispensing apparatus for mounting on a handle of a clothes iron and dispensing a fluid onto a surface of a piece of fabric.

Yet another object of the present invention is to provide a new refillable dispensing apparatus which includes a housing that has an interior for holding a fluid and an access opening for accessing the interior of the housing. A plug is removably positioned in the access opening for selectively plugging the access opening. A nozzle is mounted on and extends away from a first end wall of the housing for emitting the fluid positioned in the interior of the housing. An actuating member is mounted on the housing and is fluidly coupled to the nozzle for selectively receiving a finger of a user. A securing member is mounted to the housing for removably securing the housing to the handle of the clothes iron.

Still yet another object of the present invention is to provide a new refillable dispensing apparatus that reduces the repetitive motion of reaching for and grabbing a starch bottle to spray on fabrics that are being ironed.

Even still another object of the present invention is to provide a new refillable dispensing apparatus that is refillable and portable. The present invention is ideal for travels with limited luggage space. Instead of carrying a large can of starch, a traveler may take the present invention and removably couple it to a complementary clothes iron in a hotel. Once the present invention is emptied, a user may refill time and again.

These together with other objects of the invention, along with the various features of novelty which characterize the invention, are pointed out with particularity in the claims annexed to,and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
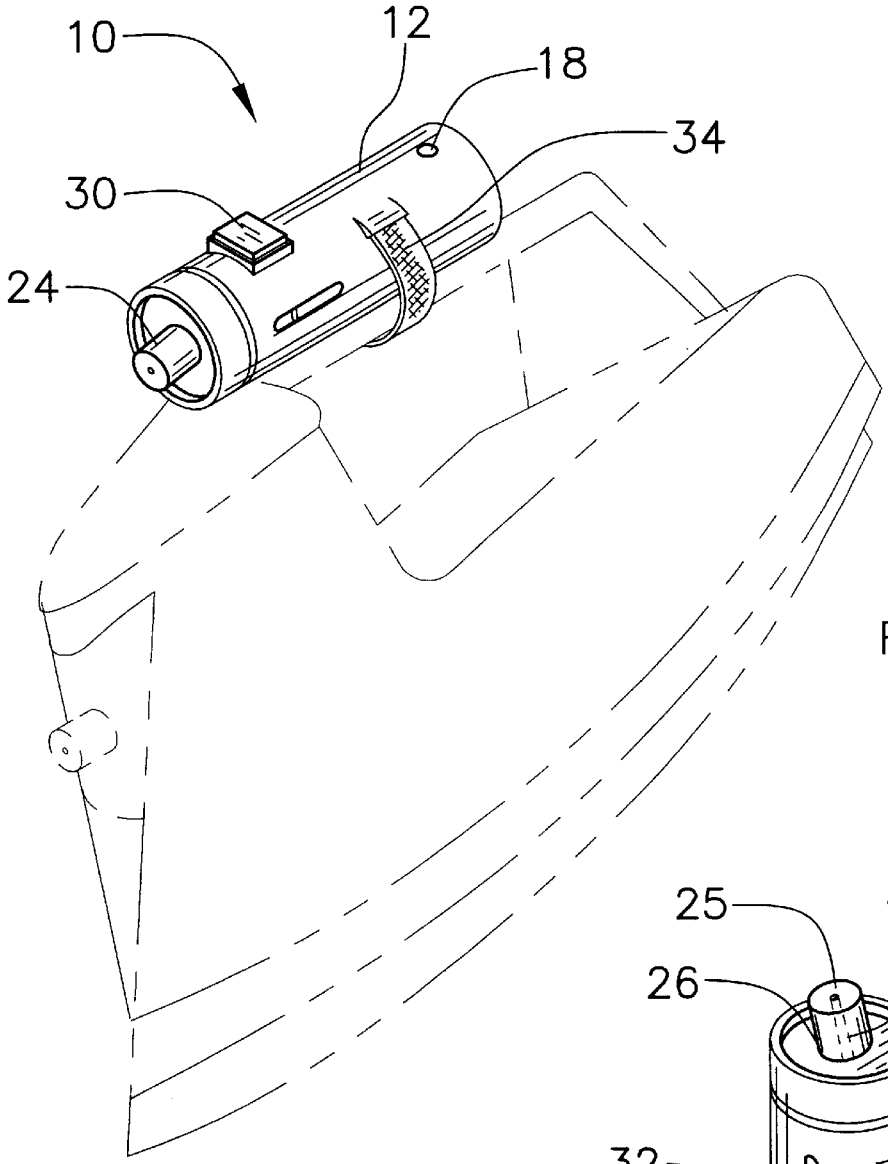
FIG. 1 is a schematic perspective view of a new refillable dispensing apparatus according to the present invention.
Figure 2:
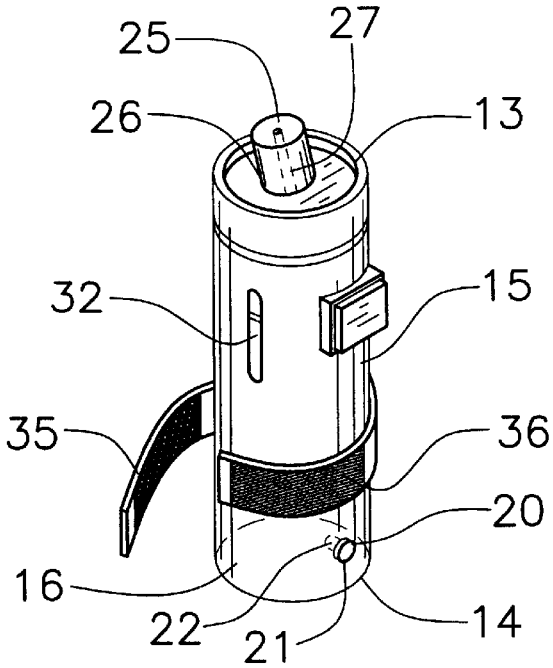
FIG. 2 is a schematic perspective view of the present invention.

With reference now to the drawings, and in particular to FIGS. 1 through 2 hereof, a new refillable dispensing apparatus embodying the principles and concepts of the present invention and generally designated by the reference numeral 10 will be described.

As best illustrated in FIGS. 1 through 2 the refillable dispensing apparatus 10 generally comprises a housing 12 that has first 13 and second 14 opposed end walls. A peripheral wall 15 extending between the first 13 and second 14 end walls defines an interior 16 of the housing 12. A longitudinal axis extends between the first 13 and second 14 end walls of the housing 12.

The housing 12 may be generally cylindrical such that the housing 12 includes a generally circular transverse cross section taken substantially perpendicular to the longitudinal axis of the housing 12. The housing 12 may employ a variety of shapes.

The peripheral wall 15 of the housing 12 includes an access opening 18 for accessing the interior 16 of the housing 12. The access opening 18 may be positioned generally nearer the second end wall 14 of the housing 12 than the first end wall 13 of the housing 12. In one embodiment of the present invention, a user pours a fluid such as, for example, starch or water through the access opening 18 into the interior 16 of the housing 12.

As illustrated in FIG. 2, a plug 20 is removably positioned in the access opening 18 for selectively plugging the access opening 18 and preventing the fluid from escaping. The plug 20 may include a base member 21 and a protruding member 22 that is mounted to and extends away from the base member 21. In one embodiment of the present invention, the protruding member 22 is removably positioned in and blocks the access opening 18. The plug 20 may comprise a generally flexible material such as, for example, a rubber or plastic material.

As illustrated in FIGS. 1 and 2, a nozzle 24 is mounted on and extends away from the first end wall 13 of the housing 12 for emitting the fluid positioned in the interior 16 of the housing 12 onto a surface of a fabric. The nozzle 24. has a first end 25 and a second end 26. The nozzle 24 has a channel 27 extending through the first 25 and second 26 ends of the nozzle 24. The channel 27 is in fluid communication with the interior 16 of the housing 12. The nozzle 24 may include a longitudinal axis extending between the first 25 and second 26 ends of the nozzle 24.

In one embodiment of the present invention, the first end 25 of the nozzle 24 may be pointed in a direction of the surface of the fabric such that the longitudinal axis of the nozzle 24 intersects the surface of the fabric and the longitudinal axis of the housing 12.

An actuating member 30 is provided for selectively receiving a finger of a user. The actuating member 30 may be depressibly mounted on the peripheral wall 15 of the housing 12. The actuating member 30 is fluidly coupled to the nozzle 24. The actuating member 30 may be fluidly coupled to the nozzle 24 by means of a conduit. In one embodiment of the present invention, the fluid in the interior 16 of the housing 12 is emitted from the nozzle 24 when the actuating member is depressed. The actuating member 30 may comprise a pump.

As illustrated in FIGS. 1 and 2, a window 32 is mounted on the peripheral wall 15 of the housing 12 for viewing the amount of the fluid in the interior 16 of the housing 12. The window 32 may include a longitudinal axis extending along the longitudinal axis of the housing 12. The window 32 may comprise a substantially transparent material such as, for example, a plastic or glass material.

A securing member 34 is provided for removably securing the housing 12 to the handle of the clothes iron. The securing member 34 may include a first securing portion 35 and a second securing portion 36. The first securing portion 35 may be mounted to and may extend away from the peripheral wall 15 of the housing 12. The second securing portion 36 may be mounted to and may extend away from the peripheral wall 15 of the housing 12. The first 35 and second 36 securing portions may be diametrically opposed on the peripheral wall 15 of the housing 12.

The first 35 and second 36 securing portions may be extendable about the handle of the clothes iron and may be releasably secured together. In one embodiment of the present invention, one of the securing portions 35 and 36 may be coupled to the peripheral wall 15 of the housing 12 and the other securing portion 35 or 36 may be extendable about the handle of the iron and releaseably secured to the securing portion 35 or 36 coupled to the peripheral wall 15 of the housing 12.

In one embodiment of the present invention, the housing 12 is removably secured to the handle of the clothes iron such that the nozzle is positioned generally adjacent to a first end wall of the clothes iron. The securing member 34 may comprise a hook and loop fastener. However, other types of securing members may be employed to secure the housing 12 to the handle of the clothes iron.

In use, fluid is poured into the interior 16 of the housing 12. The housing 12 is releaseably secured to the handle of the clothes iron. When a user needs the fluid such as starch, the user depresses the actuating member 30 which causes the fluid to spray out of the first end 25 of the nozzle 34 and onto the fabric being ironed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A refillable dispensing apparatus for coupling to a clothes iron and dispensing a fluid onto a surface of a piece of fabric, the clothes iron including a housing having first and second ends, a handle mounted on the housing and a heating element mounted on the housing for ironing the piece of fabric, said apparatus comprising:

a housing having an interior and an access opening for accessing said interior of said housing;

a plug being removably positioned in said access opening for selectively plugging said access opening;

a nozzle being mounted on and extending away from a first end wall of said housing for emitting the fluid positioned in said interior of said housing;

an actuating member being mounted on said housing for selectively receiving a finger of a user, said actuating member being fluidly coupled to said nozzle;

a securing member being mounted to said housing for removably securing said housing to the handle of the clothes iron; and a window being mounted on a peripheral wall of said housing for viewing the amount of the fluid in said interior of said housing.

2. The refillable dispensing apparatus of claim 1, wherein said housing has a longitudinal axis, said housing being generally cylindrical such that said housing has a generally circular transverse cross section taken substantially perpendicular to said longitudinal axis of said housing.

3. The refillable dispensing apparatus of claim 1, wherein said housing has a peripheral wall, wherein said access opening extends through said peripheral wall of said housing, wherein a user fills said housing with the fluid by pouring the fluid through said access opening in said housing.

4. The refillable dispensing apparatus of claim 1, wherein said plug has a base member and a protruding member being mounted to and extending away from said base member, wherein said protruding member is removably positioned in said access opening.

5. The refillable dispensing apparatus of claim 1, wherein said nozzle has a first end and a second end, said nozzle having a channel extending through said first and second ends of said nozzle, said channel being in fluid communication with said interior of said housing.

6. The refillable dispensing apparatus of claim 5, wherein said nozzle has a longitudinal axis extending between said first and second ends of said nozzle, wherein said first end of said nozzle is pointed in a direction of a surface such that said longitudinal axis of said nozzle intersects the surface and a longitudinal axis of said housing.

7. The refillable dispensing apparatus of claim 1, wherein said housing has a peripheral wall, said actuating member being depressibly mounted on said peripheral wall of said housing, wherein the fluid in said interior of said housing is emitted from said nozzle when said actuating member is depressed.

8. The refillable dispensing apparatus of claim 1, wherein said actuating member comprises a pump.

9. The refillable dispensing apparatus of claim 1, wherein said window comprises a substantially transparent material.

10. The refillable dispensing apparatus of claim 1, wherein said securing member has a first securing portion and a second securing portion being mounted to and extending away from a peripheral wall of said housing, said first and second securing portions being extendable about the handle of the clothes iron and releasably secured together.

11. The refillable dispensing apparatus of claim 1, wherein said securing member comprises a hook and loop fastener.

12. The refillable dispensing apparatus as set forth in claim 1, further comprising:

said housing having first and second opposed end walls, a peripheral wall extending between said first and second end walls defining said interior of said housing, a longitudinal axis extending between said first and second end walls of said housing;

said housing being generally cylindrical such that said housing having a generally circular transverse cross section taken substantially perpendicular to said longitudinal axis of said housing;

said peripheral wall of said housing having an access opening for accessing said interior of said housing, said access opening being positioned generally nearer said second end wall of said housing than said first end wall of said housing, wherein filling said interior of said housing with the fluid through said access opening;

said plug having a base member and a protruding member being mounted to and extending away from said base member, wherein said protruding member is removably positioned in said access opening such that said protruding member blocks said access opening;

said plug comprising a generally flexible material;

said nozzle having a first end and a second end, said nozzle having a channel extending through said first and second ends of said nozzle, said channel being in fluid communication with said interior of said housing, said nozzle having a longitudinal axis extending between said first and second ends of said nozzle;

said first end of said nozzle being pointed in a direction of said surface such that said longitudinal axis of said nozzle intersects the surface and said longitudinal axis of said housing;

an actuating member for selectively receiving a finger of a user, wherein the fluid in said interior of said housing is emitted from said nozzle when said actuating member is depressed;

said actuating member comprising a pump;

said window having a longitudinal axis extending along said longitudinal axis of said housing;

said window comprising a substantially transparent material;

said securing member for removably securing said housing to the handle of the clothes iron, said securing member having a first securing portion and a second securing portion, said first securing portion being mounted to and extending away from said peripheral wall of said housing, said second securing portion being mounted to and extending away from said peripheral wall of said housing, said first and second securing portions being diametrically opposed on said peripheral wall of said housing;

said first and second securing portions being extendable about the handle of the clothes iron and releasably secured together, wherein said housing is removably secured to the handle of the clothes iron such that said nozzle is positioned generally adjacent to the first end of the clothes iron; and said securing member comprising a hook and loop fastener.

13. A refillable dispensing apparatus for coupling to a clothes iron and dispensing a fluid onto a surface of a piece of fabric, the clothes iron including a housing having first and second ends, a handle mounted on the housing and a heating element mounted on the housing for ironing the piece of fabric, said apparatus comprising:

a housing having an interior and an access opening for accessing said interior of said housing;

a plug being removably positioned in said access opening for selectively plugging said access opening;

a nozzle being mounted on and extending away from a first end wall of said housing for emitting the fluid positioned in said interior of said housing;

an actuating member being mounted on said housing for selectively receiving a finger of a user, said actuating member being fluidly coupled to said nozzle;

a securing member being mounted to said housing for removably securing said housing to the handle of the clothes iron; and said securing member having a first securing portion and a second securing portion being mounted to and extending away from a peripheral wall of said housing, said first and second securing portions being extendable about the handle of the clothes iron and releasably secured together.

14. The refillable dispensing apparatus of claim 13, wherein said housing has a longitudinal axis, said housing being generally cylindrical such that said housing has a generally circular transverse cross section taken substantially perpendicular to said longitudinal axis of said housing.

15. The refillable dispensing apparatus of claim 13, wherein said housing has a peripheral wall, wherein said access opening extends through said peripheral wall of said housing, wherein a user fills said housing with the fluid by pouring the fluid through said access opening in said housing.

16. The refillable dispensing apparatus of claim 13, wherein said plug has a base member and a protruding member being mounted to and extending away from said base member, wherein said protruding member is removably positioned in said access opening.

17. The refillable dispensing apparatus of claim 13, wherein said nozzle has a first end and a second end, said nozzle having a channel extending through said first and second ends of said nozzle, said channel being in fluid communication with said interior of said housing.

18. The refillable dispensing apparatus of claim 17, wherein said nozzle has a longitudinal axis extending between said first and second ends of said nozzle, wherein said first end of said nozzle is pointed in a direction of a surface such that said longitudinal axis of said nozzle intersects the surface and a longitudinal axis of said housing.

19. The refillable dispensing apparatus of claim 13, wherein said housing has a peripheral wall, said actuating member being depressibly mounted on said peripheral wall of said housing, wherein the fluid in said interior of said housing is emitted from said nozzle when said actuating member is depressed.

20. A refillable dispensing apparatus for coupling to a clothes iron and dispensing a fluid onto a surface of a piece of fabric, the clothes iron including a housing having first and second ends, a handle mounted on the housing and a heating element mounted on the housing for ironing the piece of fabric, said apparatus comprising:

a housing having an interior and an access opening for accessing said interior of said housing;

a plug being removably positioned in said access opening for selectively plugging said access opening;

a nozzle being mounted on and extending away from a first end wall of said housing for emitting the fluid positioned in said interior of said housing;

an actuating member being mounted on said housing for selectively receiving a finger of a user, said actuating member being fluidly coupled to said nozzle;

a securing member being mounted to said housing for removably securing said housing to the handle of the clothes iron; and said securing member comprising a hook and loop fastener.

* * * * *